US006216895B1

(12) United States Patent
Erdmann et al.

(10) Patent No.: US 6,216,895 B1
(45) Date of Patent: Apr. 17, 2001

(54) LATERAL JIB LOCKING DEVICE

(75) Inventors: Gerd Erdmann, Unterägeri; Frank Richter, Wilhelmshaven, both of (DE)

(73) Assignee: Grove U.S. L.L.C., Shady Grove, PA (US)

( * ) Notice: Subject to any disclaimer, the term of this patent is extended or adjusted under 35 U.S.C. 154(b) by 0 days.

(21) Appl. No.: 09/272,178

(22) Filed: Mar. 18, 1999

(30) Foreign Application Priority Data

Mar. 18, 1998 (DE) ..... 198 11 813

(51) Int. Cl.[7] ..... B66C 23/04
(52) U.S. Cl. ..... 212/292; 212/348
(58) Field of Search ..... 212/292, 348, 212/249, 350; 292/35, 36, 40, 144, 201; 52/118

(56) References Cited

U.S. PATENT DOCUMENTS

| | | | | |
|---|---|---|---|---|
| 2,310,887 | * | 2/1943 | Anderson | 292/144 |
| 3,670,465 | * | 6/1972 | Cheze | 52/115 |
| 3,692,353 | * | 9/1972 | Lynde | 292/36 |
| 3,845,866 | * | 11/1974 | Eucken | 212/292 |
| 4,036,372 | * | 7/1977 | Rao et al. | 212/292 |
| 4,327,533 | * | 5/1982 | Sterner | 212/292 |
| 4,490,951 | | 1/1985 | Mentzer et al. . | |
| 4,635,805 | | 1/1987 | Mentzer . | |
| 5,537,125 | * | 7/1996 | Harrell et al. | 52/118 |
| 5,628,416 | * | 5/1997 | Frommelt et al. | 212/292 |

FOREIGN PATENT DOCUMENTS

| | | | | |
|---|---|---|---|---|
| 2528129C2 | | 6/1975 | (DE) . | |
| 4018222A1 | | 6/1990 | (DE) . | |
| 4344795A1 | | 12/1993 | (DE) . | |
| 0093160 | | 10/1982 | (EP) . | |
| 499208 | * | 2/1992 | (EP) | 212/350 |
| 1068377 | * | 1/1984 | (SU) | 212/349 |
| 1255555 | * | 9/1986 | (SU) | 212/348 |

* cited by examiner

*Primary Examiner*—Thomas J. Brahan
(74) *Attorney, Agent, or Firm*—Birch, Stewart, Kolasch & Birch, LLP

(57) ABSTRACT

A locking assembly for the telescopic jib of a crane, or mobile crane, includes a plurality of telescopic sections wherein locking pins are supported in an inner telescopic section and are biased outwardly by means of a spring for engagement within receiving apertures in an outer telescopic section surrounding the inner telescopic section. A release device is provided for engaging the inner end of a locking pin in order to release the locked position thereof against the spring biased. Preferably two locking pin are provided for each locking unit and are disposed on the inner telescopic section so that they will engage two oppositely located receiving apertures in the vertical side webs of the outer telescopic section. The engagement of the locking pins is located in the middle portion of the side webs where bending stresses are minimal, so that any weakening of the telescopic sections caused by the provision of the locking pin mounting structure and pin receiving portions will have negligible effect on the bending strength of the jib.

20 Claims, 4 Drawing Sheets

LATERAL JIB LOCKING DEVICE

BACKGROUND OF THE INVENTION

The present invention relates to a locking device for telescopic sections of a telescopic jib, and more particularly to the jib of a crane or mobile crane having such a locking device.

Crane jib telescopic sections are lockable in the extended condition to, among other things, relieve the load on the telescoping system. This applies especially when use is made of entraining means, for example piston/cylinder units, for extending the telescopic sections in bringing one telescopic section after the other into the extended or retracted positions.

For locking telescopic sections use is made mostly of locking pins, which engage from one telescopic section into a receiving portion of the adjoining telescopic section. In earlier practice such pins were retracted from the outer side of a surrounding telescopic section inward into a receiving portion of the telescopic section located within. On the one hand, this is an unsightly disadvantage, since exposed locking units spoil the neat design of the jib as a whole. On the other hand, such conventional jibs and pinning systems necessitate disposing a power supply (hydraulics, pneumatic system, etc) to the pinning means on the outer side of the jib, which is a technical complication to be avoided.

In a very early practice, such as disclosed in U.S. Pat. No. 4,036,372 a locking system with locking pins engage from an inner telescopic section outwards into receiving portions of an outer telescopic section, as a result of which the locking system could be disposed in the interior of the jib, thus obviating the need of locating power supplies on the outer side of the jib. However, the drawback in this system is that each of the locking pins engages the upper or lower plates of the telescopic section, i.e. at locations at which maximum bending stresses (tension at the top, compression below) occurs due to the external loads. In addition to this the release device described in this patent operates with double-acting cylinders and is thus, for this reason alone, relatively complicated.

Known from EP O 661 213 Al is a locking device for telescopic sections in which a locking pin guided in an inner telescopic section is able to engage a receiving portion in an outer telescopic section. This document describes the use of spring-biased locking pins in which the pin is maintained in a locked position by the force of a spring, whilst the inner end of the pin can be engaged by a hydraulic release device to return the pin into the released position in overcoming the force of a spring. A parallel description of the same design is described in U.S. Pat. No. 5,628,416.

In the last-mentioned locking device only a single locking pin is provided for locking two telescopic sections, this locking pin engaging the top flange shells of the jib sections in the middle. Thus, here too, there is again the disadvantage that the passages for the locking pins are provided just in the cross-sectional zone of the jib profile where maximum tensile stresses occur and, therefore, the structure of the jib sections is interrupted at an unsuitable location due to the recesses.

SUMMARY OF THE INVENTION

It is an object of the present invention to provide a locking device for telescopic jibs which obviates the above mentioned drawbacks of prior art, it being more particularly the intention to provide a locking device which permits a necessary structural weakening of the jib profile with minimum disadvantage to stability.

This object is achieved in accordance with the invention in that two locking pins, each of a locking unit, are arranged on each inner telescopic section so that they can be caused to engage with two oppositely located receiving portions in the vertical side webs of the outer telescopic section, i.e. preferably in the middle portion of the side webs.

The special advantage afforded by the locking device in accordance with the invention is that the receiving portions and passages needed for the locking pins are disposed in a zone of the jib in which the bending load forces produce bending stresses in the jib of no significance. In loading a jib or its telescopic sections when lifting a load a maximum tensile stress occurs on the upper side of the profile and a maximum compressive stress materializes on the underside.

This also applies to the side webs of the profile, a zone materializing, however, which is substantially stress-neutral in the middle portion of the side web. In accordance with the invention it is just in this substantially stress-neutral zone that the locking units are now disposed so that the structural weakening materializing from the necessary passages in the webs are of minimum disadvantage to the stability in this case. Since the bending stresses occurring in this case are relatively slight, this weakening of the structure is minimal and acceptable.

In one preferred embodiment of the present invention the release device comprises a hydraulic actuating cylinder arranged on a piston/cylinder unit, more particularly on the head of the cylinder at the piston output end parallel to the longitudinal axis thereof. The aforementioned piston/cylinder unit serves to extend or retract the telescopic sections and is thus already provided with a hydraulic system. This hydraulic system can be made use of simultaneously to actuate the hydraulic actuating cylinder, which is arranged to advantage space-savingly parallel to the longitudinal axis of the piston/cylinder unit.

The release device preferably comprises a lever, which converts the actuation of the hydraulic actuating cylinder so that an engaging end of the lever is moved substantially in the axial direction of the locking pins. By means of such a lever simple and reliable conversion of the direction of movement of the actuating cylinder by 90° is assured.

The engaging end of the lever is preferably configured so that on axial travel of the piston/cylinder unit it can be brought into engagement with a clasp at the inner end of the locking pin. For this purpose the engaging end of the lever advantageously comprises a T-shaped protuberance which can be brought into engagement with a longitudinally slotted clasp on the inner end of the locking pin, thus making it possible to bring this release device into the respective position suitable for releasing the locking pins by the method of the release device with the head of the piston/cylinder unit. When the device is moved each time to the suitable location by position monitoring, the engaging end of the lever of the release device engages the inner clasp of the locking pin so that the locked position can be released when the hydraulic cylinder is set in motion. In this arrangement it needs to be assured that the jib sections are retained at all times either by means of the locking pins or are locked in place by an entraining device.

In one embodiment of the locking device in accordance with the invention the release device is arranged on the head of the piston/cylinder unit above an entraining device for extending the telescopic sections, the locking pins being located parallel to the entraining pins. In this arrangement the entraining device may be a conventional assembly having extensible entraining pins and receiving portions provided therefor in the telescopic sections In a further advantage aspect of the locking device in accordance with the invention the outer end of the locking pins comprises a nose protruding opposite to the telescopic extension direction. In the locked condition of two sections the nose clasps the adjoining part of the receiving portion behind the outer wall of the outer section.

Unlike the fully surrounding safety collars as proposed in prior art (see EP O 661 231 Al) a nose such as above permitting hook attachment to the outer telescopic section thus ensuring that the pin in the locked condition of two telescopic sections cannot be accidentally retracted, has the advantage that when the lock is released, i.e. when the telescopic cylinder is extended somewhat with the inner section to enable the locking pin to be retracted there is no longer the danger of the pin snagging in the direction of telescopic extension or laterally in the receiving portion.

Provided on the locking pin furthermore in one advantageous embodiment of the invention is an emergency actuator which, more particularly, engages the inner end at the clasp and which may be an unlocking lever with a screw adjustment. By means of this emergency actuator the locking pin can be returned to a retracted release position should the hydraulic actuator become inoperative.

A telescopic jib in accordance with the invention suitable for use, more particularly, on a crane and especially on a mobile crane, comprises a locking device as described above by the various embodiments.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
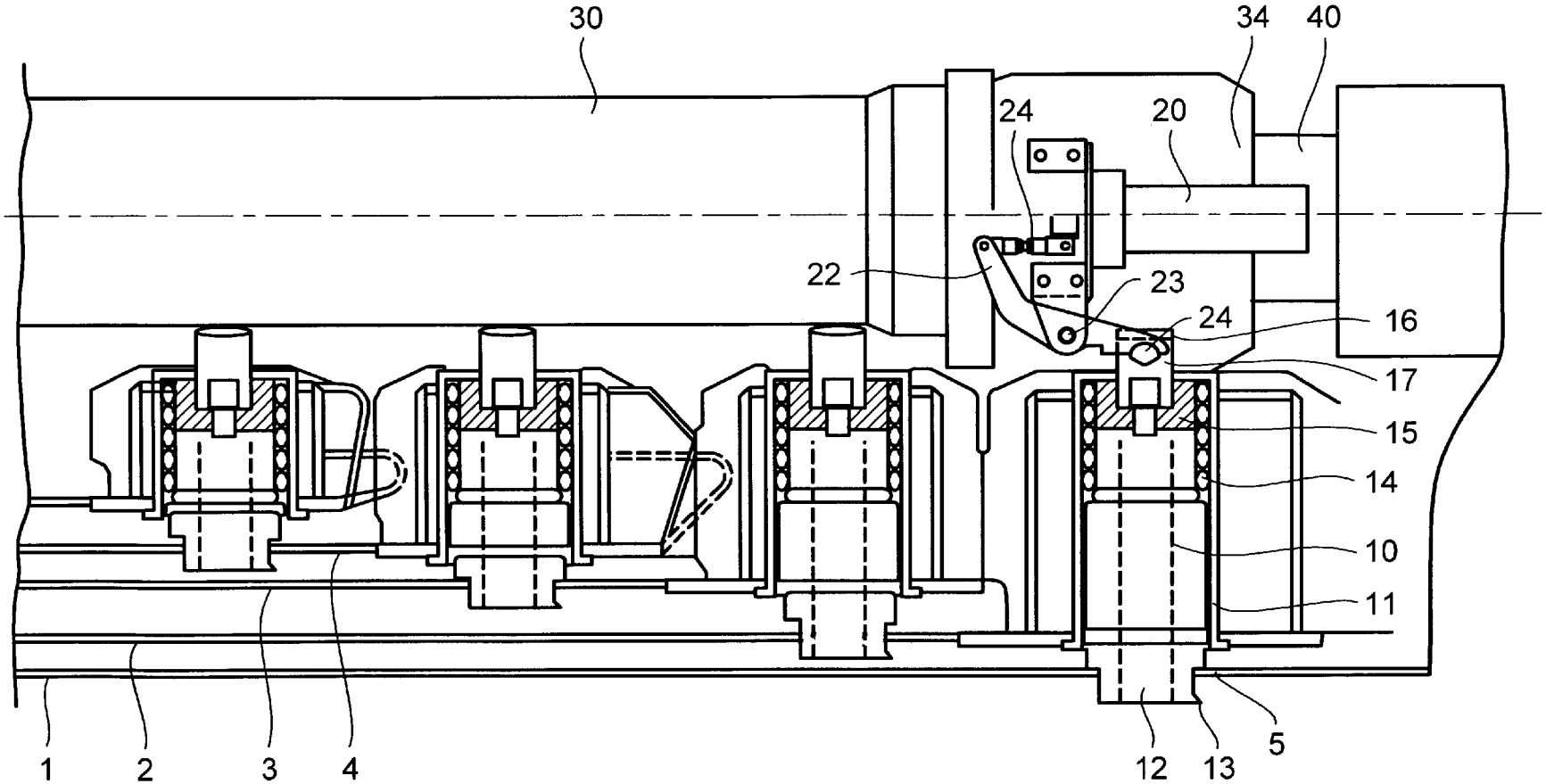
FIG. 1 is a longitudinal, partial section of a locking and release device in accordance with the invention as viewed from above, whereby only one side of the jib portion is shown.
Figure 3:
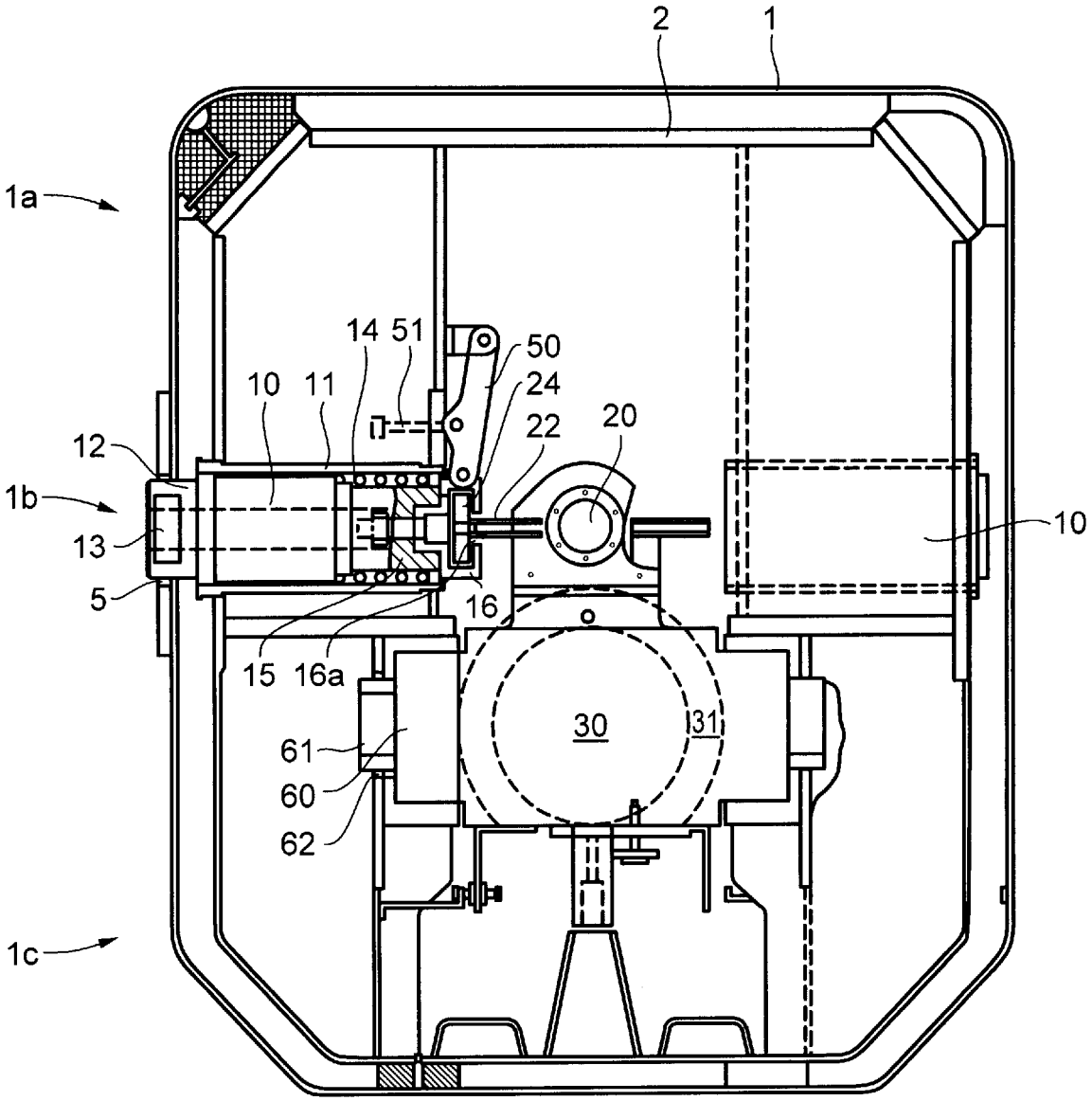
FIG. 3 is a transverse cross-section through two telescopic sections in the region of the locking device.

Referring now to FIG. 1 there is illustrated the longitudinal section of a jib portion, namely the left hand portion as shown in FIG. 3 as seen from above, depicting the jib sections 1, 2, 3 and 4, which in this sequence make up the crane jib outside in.

The locking device will now be discussed on the basis of the locking pin 10 used to lock the two outermost telescopic sections 1 and 2. The pin 10 is mounted axially shiftable in a housing 11 locked in place in the telescopic section 2. By its outer end 12 the pin 10 penetrates the outer telescopic section 1 through a receiving portion 5. To safeguard this locked condition the outer end 12 of the pin 10 features the nose 13 which hooks in place behind the outer wall of the section 1 in the locked condition.

Figure 4:
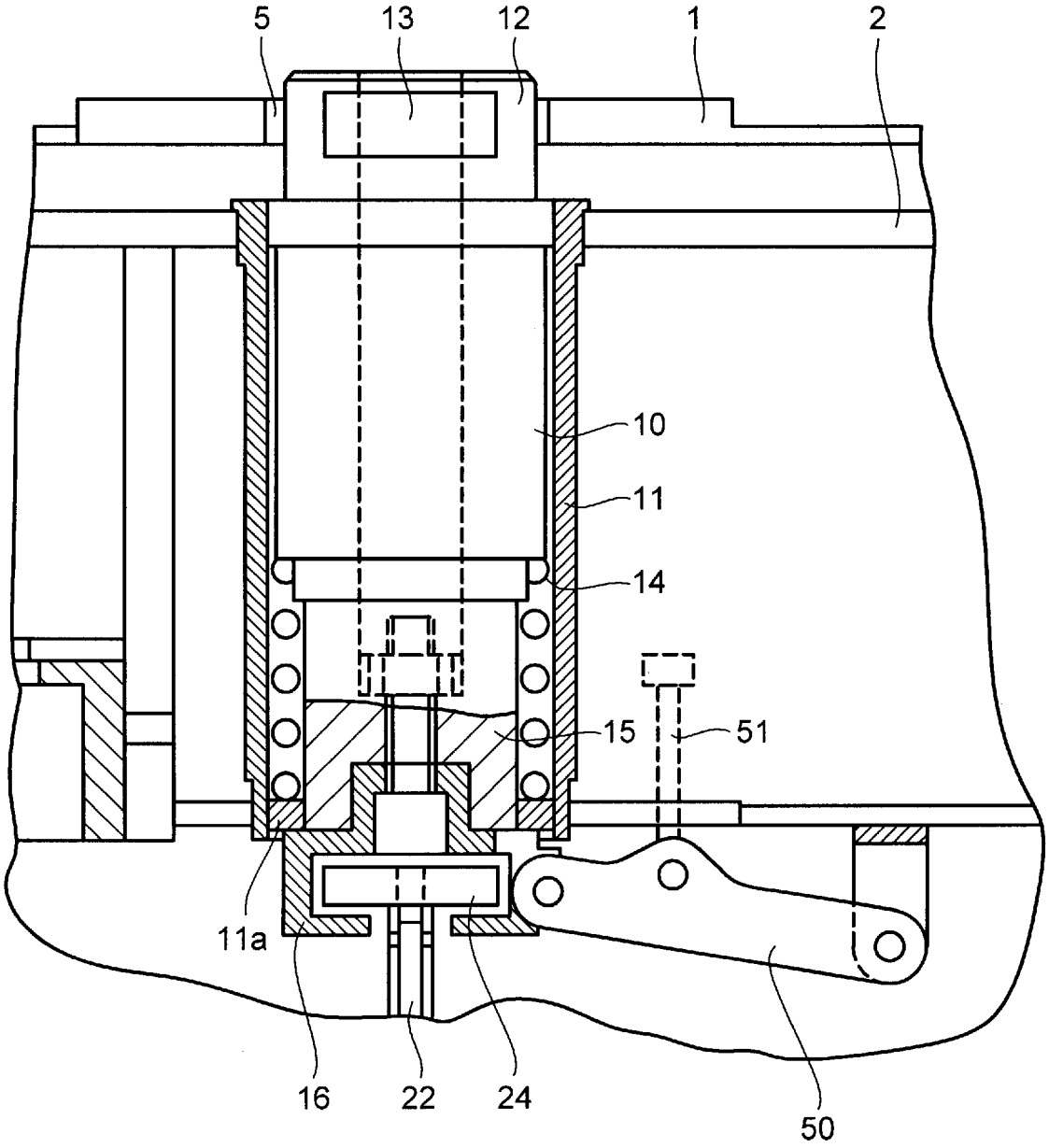
FIG. 4 is a detail as shown in FIG. 3 but on a magnified scale.

As mentioned, the pin 10 is shiftingly mounted in the housing 11, and it is biased by means of a spring 14 in the direction of the locked position, i.e. outwardly, whereby the spring is supported by an inner ridge on the pin 10 as well as by the inner face end of the housing 11 formed by a welded ring 11*a* serving to guide the pin 10 (see FIG. 4), i.e. by its inner end 15.

The inner end 15 of the locking pin 10 penetrates the face end of the housing 11 inwardly, i.e. by a clasp 16 arranged at this location which will be detailed later with respect to FIG. 3.

Also evident from FIG. 1 is a piston/cylinder unit which, on the one hand, is used to retract or extend the telescopic sections by means of an entraining device (not shown) and, on the other, features at the end of the cylinder 30, where the piston 40 emerges, a head 31 on which a release device 20 to 25 is mounted for the locking pins 10.

This release device consists of a hydraulic actuating cylinder 20 which can be powered via the hydraulic system of the piston/cylinder unit 40, 30. By means of the hydraulic actuating cylinder 20—when called for by the working sequence and suitable positioning of all elements has been "seen" by the position monitor—the locking pin 10 is released via a system of levers which will now be detailed with respect to FIG. 2.

Figure 2:
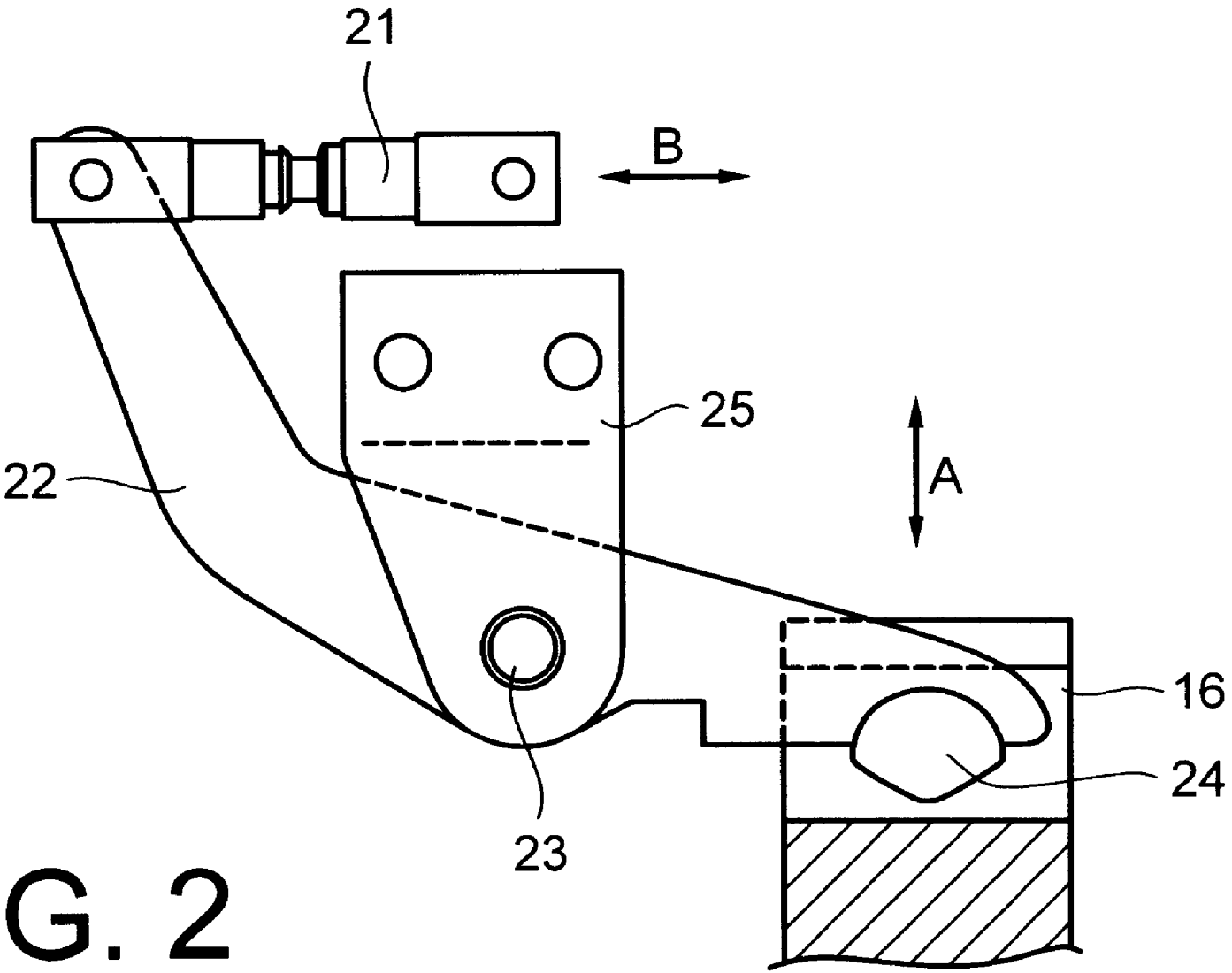
FIG. 2 is a view of a part of the release device as shown in FIG. 1 but on a magnified scale.

Referring now to FIG. 2 all parts essential to the release device, except for the hydraulic actuating cylinder 20, are evident. This release device consists of an adjuster mechanism 21 which can be moved by means of the hydraulic actuating cylinder 20 in the direction as indicated by the upper double arrow B. The left-hand end of the adjuster mechanism 21 engages a lever 22, which can be pivoted about the pivot axis 23, which in turn is locked in place by the fastener 25.

The adjuster mechanism 21 is formed by a threaded rod, the effective length of which can be varied.

In pivoting the lever 22 the axial movement (relative to the longitudinal axis of the jib) of the adjuster mechanism 21 is converted at the engaging end 24 of the lever 22 into a radial movement as indicated by the double arrow A. The engaging end 24 runs out in a T-shaped protuberance engaging the clasp 16 at the inner end 15 of the locking pin 10. By means of the radial movement as described, the locking pin 10 can thus be shifted in and out of the housing 11, i.e. from a released position into a locked position (and vice-versa).

Referring now to FIG. 3 illustrating a cross-section in the locking portion, it is now evident that two locking pins 10 in each case by this configuration in accordance with the invention can be caused to engage two oppositely located receiving portions in the vertical side webs of the outer telescopic section. This arrangement is essentially symmetrical so that the following details relate to the left-hand side only.

The outer telescopic section 1 is divided on its left-hand side into the upper portion 1*a*, the middle portion 1*b* and the lower portion 1*c*. In a loading situation, for example in lifting a weight by means of the jib, tensile forces become effective in the upper portion 1*a* of the side webs producing the highest tensile stress at the upper end, whereas in the lower portion 1*c* compressive forces are effective with a maximum at the lowermost point.

In the middle portion 1*b* of the side webs no, or only minor, material stresses exist, stemming from the bending load. In accordance with the invention the locking device has been placed in this portion so that the necessary material penetrations, for example the receiving portion 5, weaken the stability of the jib overall only to a negligible extent.

It is in this perspective that the locking pin 10 biased in the housing 11 by the spring 14 is in turn to be seen, which passes through the outer telescopic section 1 at the receiving portion 5 by its outer end 12 and the nose 13. Here, more clearly seen than in FIG. 1, the inner end 15 of the pin 10 is evident, comprising at its innermost position a clasp 16 in which the engaging end 24 of the lever 22 resides, in the condition as shown, the lever 22 being actuated by the release device shown in detail in FIG. 2 via the hydraulic actuating cylinder 20. Due to the longitudinal slot 16*a* in the clasp 16 the engaging end 24 of the lever 22 is able to enter this clasp 16 in a direction perpendicular to the plane of the drawing in FIG. 3 (i.e. in the axial direction of the jib).

When the engaging end 24 is located in the clasp 16, pivoting the lever 22 (see FIG. 2) enables the engaging end 24 to be moved to the right, as shown in FIG. 3, causing the pin 10 to be likewise moved to the right from the locked position into a released position, as a result of which the spring 14 is compressed, causing the telescopic sections 1 and 2 to be no longer interlocked and they can thus be shifted relative to each other with the aid of an entraining device 60.

The entraining device 60 (generally indicated in FIG. 3) comprises for example the receiving portions 62 provided in the inner telescopic section for the entraining pins 61 located in the head 31 of the piston/cylinder unit 30, the position of these components again being merely indicated by the broken lines.

Also evident from FIG. 3 is a emergency actuator for the locking pin 10, which in this case simply comprises a lever 50 engaging on one side the clasp 16 and on the other side a fixedly mounted stand. By means of the screw 51 the lever 50 can be pivoted manually to the right, as a result of which the locking pin 10 can be released (manually) even if the hydraulics system has become inoperative. At the same time, the lever prevents rotation of the pin 10 so that the engaging end 24 is always able to travel through the longitudinal slot 16*a* into the clasp 16.

The locking action is sequenced as follows: Once, on extension of the telescopic section 2 by means of the entraining device 60 (i.e. the piston/cylinder unit 40, 30), the locking pin 10 has attained the position in which it is directly located at the receiving portion 5 in the outer telescopic section, pivoting the lever 22 via the hydraulic actuating cylinder 20 releases the movement of the pin 10 due to the spring bias 14, and the pin 10 moves outwardly by its outer end 12 into the receiving portion 5 and thus through the outer telescopic section 1. The inner telescopic section 2 can then be retracted somewhat so that the outer telescopic section 1 hooks into place with the nose 13 of the pin 10, it thereby being locked in place. The entraining device is then able to release and axially travel the telescopic section 2.

When the lock again needs to be released, the entraining device is travailed axially so that, on the one hand, the entraining pins 61 can be caused to engage the receiving portion 62 and, on the other, the engaging end 24 of the lever 22 of the release device caused to engage the clasp 16 at the inner end 15 of the pin 10. It is to be noted that at this point all locking pins of the jib in the various telescopic sections are located in the locked condition so that their clasps 16 have the same level radially. To bring this about, the locking pins of the inner telescopic sections are configured shorter as is evident from FIG. 1.

When, then, in the unlocking action, as indicated above, the engaging end 24 is located in the clasp 16 the lever 22 can be in turn pivoted via the hydraulic actuating cylinder 20 so that the engaging end 24 is moved radially to the right (as shown in FIG. 3), entraining the pin 10 in its movement and shifting it into the unlocked position with the spring 14 compressed. For this purpose the telescopic section 2 should be extended somewhat by the piston/cylinder unit 40, 30 to release the engagement of the nose 13.

In this unlocked position the telescopic section 2 is then retained merely by the entraining pin 61 of the entraining device 60 and can be moved to another position As already mentioned, the individual locking components are each provided in duplicate to the left and right of the longitudinal center plane of the jib, i.e. on both the left and right release devices 20 to 25 and locking pins 10 as well as entraining units 60–62 are arranged.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A locking telescopic boom assembly comprising:

an inner telescopic section;

an outer telescopic section including a first side web and a second side web;

a first receiving portion included on said first side web;

a second receiving portion included on said second side web;

a first locking pin connected to said inner telescopic section, a first outer end of said first locking pin being engagable with said first receiving portion;

a first spring biasing said first locking pin toward said first side web;

a second locking pin connected to said inner telescopic section, a second outer end of said second locking pin being engagable with said second receiving portion;

a second spring biasing said second locking pin toward said second side web; and a release device located within said inner telescopic section, said release device including a driven member and linkage interacting with said driven member to engage both of said first and second locking pins to release engagement of said first and second outer ends of said first and second locking pins with said first and second receiving portions.

2. The assembly as set forth in claim 1, wherein said driven member includes a hydraulic actuator.

3. The assembly as set forth in claim 1, further comprising:

a piston/cylinder unit including a piston assembly for imparting relative movement between said inner telescopic section and said outer telescopic section, wherein said release device is mounted proximate an end of said piston assembly.

4. The assembly as set forth in claim 3, further comprising:

an entraining device mounted to said piston assembly of said piston/cylinder unit, said entraining device including first and second entraining pins for engaging with one of said inner and outer telescopic sections for imparting the relative movement between said inner telescopic section and said outer telescopic section, wherein said first and second locking pins are parallel to said first and second entraining pins.

5. The assembly as set forth in claim 3, wherein said linkage includes a first lever utilizing movement of said driven member to displace said first outer end of said first locking pin from said first receiving portion; and a second lever utilizing movement of said driven member to displace said second outer end of said second locking pin from said second receiving portion.

6. The assembly as set forth in claim 5, wherein said first locking pin includes a first clasp proximate a first inner end of said first locking pin, wherein said second locking pin includes a second clasp proximate a second inner end of said second locking pin, and wherein said first lever engages said first clasp and said second lever engages said second clasp.

7. The assembly as set forth in claim 6, wherein said first lever includes a first T-shaped end for engaging said first clasp of said first locking pin, and said second lever includes a second T-shaped end for engaging said second clasp of said second locking pin.

8. The assembly as set forth in claim 7, wherein said first clasp includes a first slot for allowing a first shaft portion of said first T-shaped end of said first lever to pass therethrough as said piston assembly imparts relative movement between said inner telescopic section and said outer telescopic section, and wherein said second clasp includes a second slot for allowing a second shaft portion of said second T-shaped end of said second lever to pass therethrough as said piston assembly imparts relative movement between said inner telescopic section and said outer telescopic section.

9. The assembly as set forth in claim 8, wherein said outer telescopic section is a first outer telescopic section and further comprising:

a second outer telescopic section including a third side web and a fourth side web, said piston assembly also for imparting relative movement between said first outer telescopic section and said second outer telescopic section;

a third receiving portion included on said third side web;

a fourth receiving portion included on said fourth side web;

a third locking pin connected to said first outer telescopic section, a third outer end of said third locking pin being engagable with said third receiving portion;

a third spring biasing said third locking pin toward said third side web;

a fourth locking pin connected to said first outer telescopic section, a fourth outer end of said fourth locking pin being engagable with said fourth receiving portion; and a fourth spring biasing said fourth locking pin toward said fourth side web;

wherein said third locking pin includes a third clasp proximate a third inner end of said third locking pin; said fourth locking pin includes a fourth clasp proximate a fourth inner end of said fourth locking pin; said third clasp includes a third slot for allowing said first shaft portion of said first T-shaped end of said first lever to pass therethrough as said piston assembly imparts relative movement between said first outer telescopic section and said second outer telescopic section; and said fourth clasp includes a fourth slot for allowing said second shaft portion of said second T-shaped end of said second lever to pass therethrough as said piston assembly imparts relative movement between said first outer telescopic section and said second outer telescopic section.

10. The assembly as set forth in claim 9, wherein said first clasp and said third clasp are aligned, and said second clasp and said fourth clasp are aligned.

11. The assembly as set forth in claim 9, wherein said first, second, third and fourth slots are aligned on a common plane.

12. The assembly as set forth in claim 11, further comprising:

a first emergency actuator connected proximate said first inner end of said first locking pin to release engagement of said first outer end of said first locking pin from said first receiving portion; and a second emergency actuator connected proximate said second inner end of said second locking pin to release engagement of said second outer end of said second locking pin from said second receiving portion.

13. The assembly as set forth in claim 12, wherein said first and second emergency actuators include first and second levers engaged to said first and second clasps, respectively, and further include first and second screws which impart movement to said first and second levers and thereby impart movement to said first and second locking pins to release said first and second outer ends of said first and second locking pins from said first and second receiving portions, respectively.

14. The assembly as set forth in claim 13, wherein said first and second levers prevent said first and second locking pins from rotating about an axis of extension of said first and second locking pins, respectively.

15. The assembly as set forth in claim 1, further comprising:

a first nose attached to said first outer end of said first locking pin, said first nose overlaying an edge of said first receiving portion when said first locking pin is engaged to said first receiving portion; and a second nose attached to said second outer end of said second locking pin, said second nose overlaying an edge of said second receiving portion when said second locking pin is engaged to said second receiving portion.

16. The assembly as set forth in claims 1, wherein said outer telescopic section has a longitudinal extension direction and a shorter lateral extension direction, and wherein said first receiving portion is located in a mid portion of said outer telescopic section in said lateral extension direction and is located proximate an end of said telescopic section in said longitudinal direction.

17. The assembly as set forth in claim 1, wherein a cross section of said outer telescopic section surrounds a cross section of said inner telescopic section.

18. A mobile crane including a locking telescopic boom assembly comprising:

an inner telescopic section;

an outer telescopic section including a first side web and a second side web;

a first receiving portion included on said first side web;

a second receiving portion included on said second side web;

a first locking pin connected to said inner telescopic section, a first outer end of said first locking pin being engagable with said first receiving portion;

a first spring biasing said first locking pin toward said first side web;

a second locking pin connected to said inner telescopic section, a second outer end of said second locking pin being engagable with said second receiving portion;

a second spring biasing said first locking pin toward said second side web; and a release device located within said inner telescopic section, said release device including a driven member and linkage interacting with said driven member to engage both of said first and second locking pins to release engagement of said first and second outer ends of said first and second locking pins with said first and second receiving portions.

19. The assembly as set forth in claim 18, further comprising:

a piston/cylinder unit including a piston assembly for imparting relative movement between said inner telescopic section and said outer telescopic section, wherein said release device is mounted proximate an end of said piston assembly, and wherein said driven member includes a hydraulic actuator.

20. The assembly as set forth in claim 18, wherein said first locking pin includes a first clasp proximate a first inner end of said first locking pin, wherein said second locking pin includes a second clasp proximate a second inner end of said second locking pin, and wherein said linkage includes a first lever utilizing movement of said driven member to displace said first outer end of said first locking pin from said first receiving portion via said first clasp; and a second lever utilizing movement of said driven member to displace said second outer end of said second locking pin from said second receiving portion via said second clasp.

* * * * *